US008036558B2

(12) United States Patent
Nakashima

(10) Patent No.: US 8,036,558 B2
(45) Date of Patent: Oct. 11, 2011

(54) HEATER CONTROLLER AND IMAGE FORMING APPARATUS

(75) Inventor: Hirokazu Nakashima, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 389 days.

(21) Appl. No.: 12/408,276

(22) Filed: Mar. 20, 2009

(65) Prior Publication Data

US 2009/0245846 A1 Oct. 1, 2009

(30) Foreign Application Priority Data

Mar. 26, 2008 (JP) ..... 2008-080622

(51) Int. Cl.
*G03G 15/20* (2006.01)

(52) U.S. Cl. ..... 399/69

(58) Field of Classification Search ..... 399/38, 399/67–70; 219/216, 492, 497, 619
See application file for complete search history.

(56) References Cited

U.S. PATENT DOCUMENTS

| | | | | |
|---|---|---|---|---|
| 5,367,369 | A | 11/1994 | Nakai et al. | |
| 5,669,038 | A * | 9/1997 | Kishimoto | 399/67 |
| 5,811,764 | A * | 9/1998 | Hirst | 219/497 |
| 6,177,657 | B1 | 1/2001 | Takata | |
| 6,853,818 | B2 | 2/2005 | Nishida | |
| 7,012,222 | B2 * | 3/2006 | Choo | 219/492 |
| 2006/0051118 | A1 | 3/2006 | Kaji et al. | |

FOREIGN PATENT DOCUMENTS

| | | | |
|---|---|---|---|
| JP | 5-289561 | A | 11/1993 |
| JP | 09-080961 | | 3/1997 |
| JP | 11-344899 | A | 12/1999 |
| JP | 2003-123941 | | 4/2003 |
| JP | 2005-346475 | A | 12/2005 |
| JP | 2006-072235 | A | 3/2006 |

OTHER PUBLICATIONS

JP Office Action dtd Feb. 9, 2010, JP Appln. 2008-080622, partial English translation.

* cited by examiner

*Primary Examiner* — Hoan Tran
(74) *Attorney, Agent, or Firm* — Banner & Witcoff, Ltd

(57) ABSTRACT

A heater controller is provided. The heater controller includes a switching unit which switches a conduction state of a heater with an AC power source between ON and OFF at a timing at which an AC power voltage becomes zero; and a control unit which controls the switching unit at each unit interval corresponding to a half wave period of the AC power voltage. The control unit outputs a switch signal for switching the conduction state based on a pattern in a control time period set as an integral multiple of the half wave period. In the pattern, ON intervals in which the conduction state is to be ON, and OFF intervals in which the conduction state is to be OFF are arranged so that one of the ON intervals and the OFF intervals, a number of which is smaller are not successive within the control time period.

11 Claims, 9 Drawing Sheets

FIG. 5

50

51 53 52

| HEATER HEATING RATE | CONTROL TIME PERIOD | ARRANGEMENT PATTERN | | | | | | |
|---|---|---|---|---|---|---|---|---|
| | | HALF WAVE 1 | HALF WAVE 2 | HALF WAVE 3 | HALF WAVE 4 | HALF WAVE 5 | HALF WAVE 6 | HALF WAVE 7 |
| 100% | 1 | ON | | | | | | |
| 75% | 4 | ON | ON | ON | OFF | | | |
| 71% | 7 | ON | ON | ON | OFF | ON | ON | OFF |
| 67% | 3 | ON | ON | OFF | | | | |
| 60% | 5 | ON | ON | OFF | ON | OFF | | |
| 57% | 7 | ON | ON | OFF | ON | OFF | ON | OFF |
| 50% | 2 | ON | OFF | | | | | |
| 43% | 7 | ON | OFF | ON | OFF | ON | OFF | OFF |
| 40% | 5 | ON | OFF | ON | OFF | OFF | | |
| 33% | 3 | ON | OFF | OFF | | | | |
| 29% | 7 | ON | OFF | OFF | ON | OFF | OFF | OFF |
| 25% | 4 | ON | OFF | OFF | OFF | | | |
| 0% | 1 | OFF | | | | | | |

FIG. 7A

| TYPE OF PAPER | TARGET TEMPERATURE |
|---|---|
| OHP | 185℃ |
| THIN PAPER | 195℃ |
| RECYCLED PAPER | 205℃ |
| ORDINARY PAPER | 213℃ |
| CARDBOARD | 220℃ |

FIG. 7B

| DIFFERENCE ΔT BETWEEN TARGET TEMPERATURE AND HEATER TEMPERATURE | HEATER HEATING RATE |
|---|---|
| $6 < \Delta T$ | 100% |
| $5 < \Delta T \leqq 6$ | 75% |
| $4 < \Delta T \leqq 5$ | 71% |
| $3 < \Delta T \leqq 4$ | 67% |
| $2 < \Delta T \leqq 3$ | 60% |
| $1 < \Delta T \leqq 2$ | 57% |
| $0 < \Delta T \leqq 1$ | 50% |
| $-1 < \Delta T \leqq 0$ | 43% |
| $-2 < \Delta T \leqq -1$ | 40% |
| $-3 < \Delta T \leqq -2$ | 33% |
| $-4 < \Delta T \leqq -3$ | 29% |
| $-5 < \Delta T \leqq -4$ | 25% |
| $\Delta T \leqq -5$ | 0% |

HEATER CONTROLLER AND IMAGE FORMING APPARATUS

CROSS-REFERENCE TO RELATED APPLICATION

This application claims priority from Japanese Patent Application No. 2008-080622, filed on Mar. 26, 2008, the entire subject matter of which is incorporated herein by reference.

TECHNICAL FIELD

Aspects of the present invention relate to a heater controller for controlling a heater and an image forming apparatus including the heater controller.

BACKGROUND

A heater controller is provided in an image forming apparatus such as an electrostatic copier or a laser printer in order to control the temperature of a heater contained in a heater roller. The heater controller controls such heater in the heater roller to become a temperature appropriate for the type of sheet, for example, ordinary sheet, OHP, and the like so that a toner image onto the sheet is thermally fused (fixed) on the sheet while the sheet passing through the heater roller and a pressing roller.

Such kind of heater controller controls a halogen lamp and the like consuming comparatively large power as the heater. Therefore, a larger current fluctuation such as rush current occurs when the conduction state of the heater from an AC power source is switched between ON and OFF. This larger current fluctuation sometimes causes a flicker in the halogen lamp itself or a light emitter which is connected to the same power line as the image forming apparatus.

As an example of countermeasures against such flicker, it is conceivable to continuously control the power supplied to the heater by adopting phase control of interrupting a current in arbitrary phase. However, the waveform of the current flowing into the heater becomes discontinuous rather than a sine wave, and therefore, a harmonic current flows into the power line and terminal noise increases.

JP-A-9-80961 describes a related-art heater wave number controller which performs a wave number control of switching the ON/OFF state of a heater at the period timing at which an AC power supply voltage becomes zero (zero crossing timing), thereby controlling the conduction state of the heater in half-wave units of the AC power supply voltage to suppress occurrence of a harmonic current.

In the heater wave number controller, the switching timing of the conduction state of the heater from OFF to ON is fixed within a control time period set to an integral multiple of a half period of AC power supply voltage and the switching timing from ON to OFF is varied according to the difference between a target temperature and a current heater temperature, thereby controlling the temperature of the heater.

By the way, it is known that a level at which flicker is offensive to a human being is that a change frequency of illuminance becomes about 8.8 times per second (8.8 Hz) although it depends on the illuminance of a light emitter and an individual difference. That is, the higher the switching frequency of the heater conduction state, the shorter a change period of the illuminance (illuminance change period) of a lighting emitter so that the flicker becomes negligible.

However, in the related-art heater wave number controller, if an attempt is made to perform heater control by fractionating the set step of heater output to maintain the accuracy of temperature adjustment, the control time period needs to be long and thus the illuminance change period is prolonged according to the duration of the control time period, and there is a possibility that flicker occurs.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly it is an aspect of the present invention to provide a heater controller capable of suppressing flicker without degrading the accuracy of temperature adjustment and an image forming apparatus including the heater controller.

According to an exemplary embodiment of the present invention, there is provided a heater controller comprising: a switching unit which switches a conduction state of a heater with an AC power source between ON and OFF at a timing at which an AC power voltage from the AC power source becomes zero; and a control unit which controls the switching unit at each unit interval corresponding to a half wave period of the AC power voltage. The control unit outputs a switch signal for switching the conduction state to the switching unit based on a pattern in a control time period set as an integral multiple of the half wave period. In the pattern, ON intervals in which the conduction state is to be ON, and OFF intervals in which the conduction state is to be OFF are arranged so that one of the ON intervals and the OFF intervals, a number of which is smaller are not successive within the control time period.

According to another exemplary embodiment of the present invention, there is provided an image forming apparatus comprising: a fixing unit including a heater which heats toner transferred on a record sheet to fix the toner on the record sheet; a switching unit which switches a conduction state of the heater with an AC power source between ON and OFF at a timing at which an AC power voltage from the AC power source becomes zero; and a control unit which controls the switching unit at each unit interval corresponding to a half wave period of the AC power voltage. The control unit outputs a switch signal for switching the conduction state to the switching unit based on a pattern in a control time period set as an integral multiple of the half wave period. In the pattern, ON intervals in which the conduction state is to be ON, and OFF intervals in which the conduction state is to be OFF are arranged so that one of the ON intervals and the OFF intervals, a number of which is smaller are not successive within the control time period.

According to another exemplary embodiment of the present invention, there is provided a heater controller comprising: a setting unit which sets a conduction state of a heater with an AC power source to ON or OFF at a timing at which an AC power voltage from the AC power source becomes zero; a temperature detection unit which detects the temperature of the heater; a rate setting unit which sets an ON/OFF rate indicating a rate of the ON intervals in which the conduction state is to be ON or a rate of the OFF intervals in which the conduction state is to be OFF in a control time period based on the temperature detected by the temperature detection unit; a varying unit which varies the control time period based on the ON/OFF rate set by the ON/OFF rate; and a control unit which controls the setting unit based on the ON/OFF rate set by the rate setting unit in the varied control time period.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 5 is a matrix chart to show the arrangement of a control table according to an exemplary embodiment of the present invention;

FIG. 7A is a list to show setup examples of target temperature, and FIG. 7B is a list to show a heater heating rate according to an exemplary embodiment of the present invention;

DETAILED DESCRIPTION

Referring now to the accompanying drawings, there is described exemplary embodiments of the present invention.

[General Configuration of Image Forming Apparatus]

Figure 1:
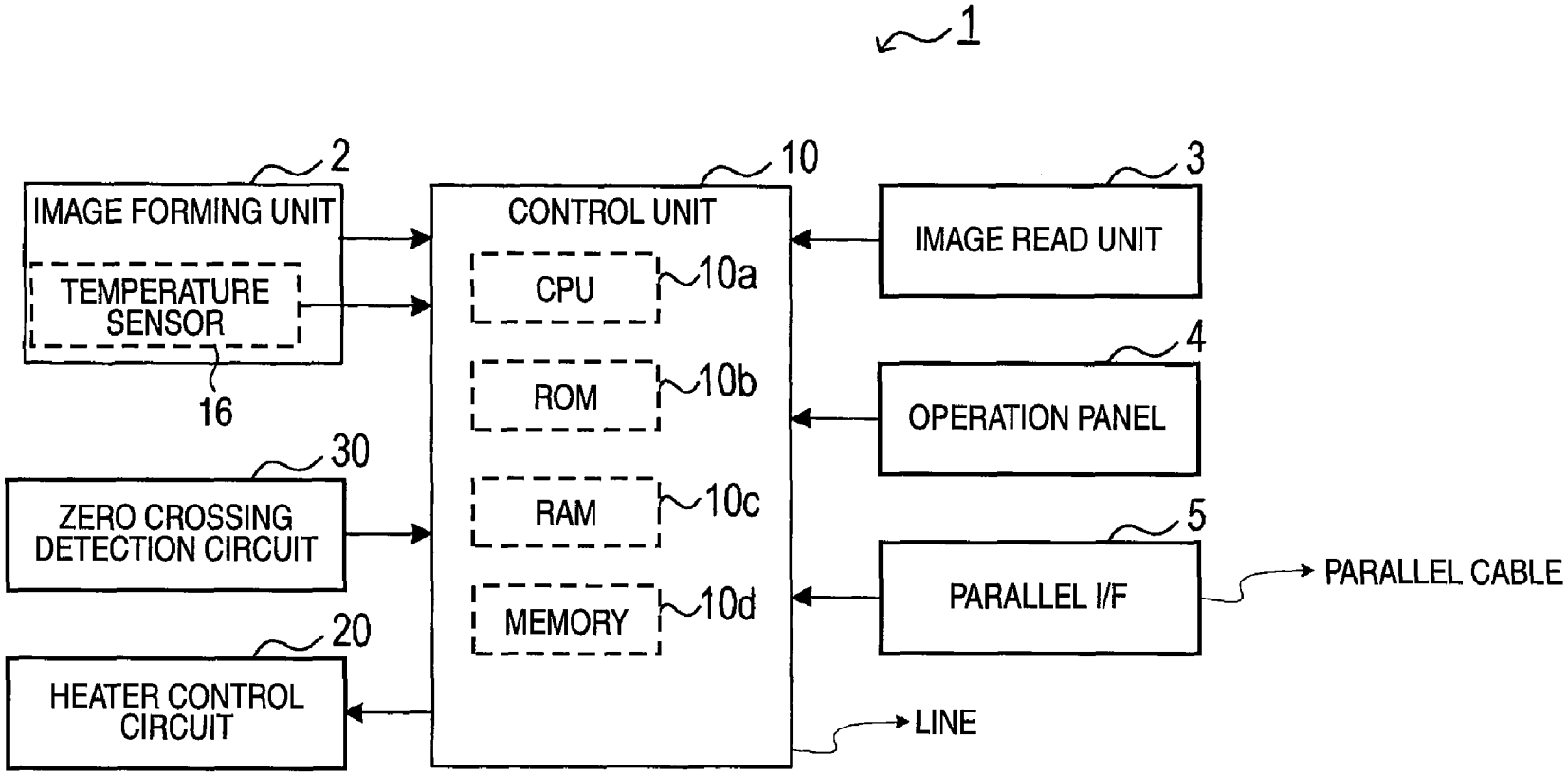
FIG. 1 is a block diagram to show the configuration of an image forming apparatus according to an exemplary embodiment of the present invention.
Figure 2:
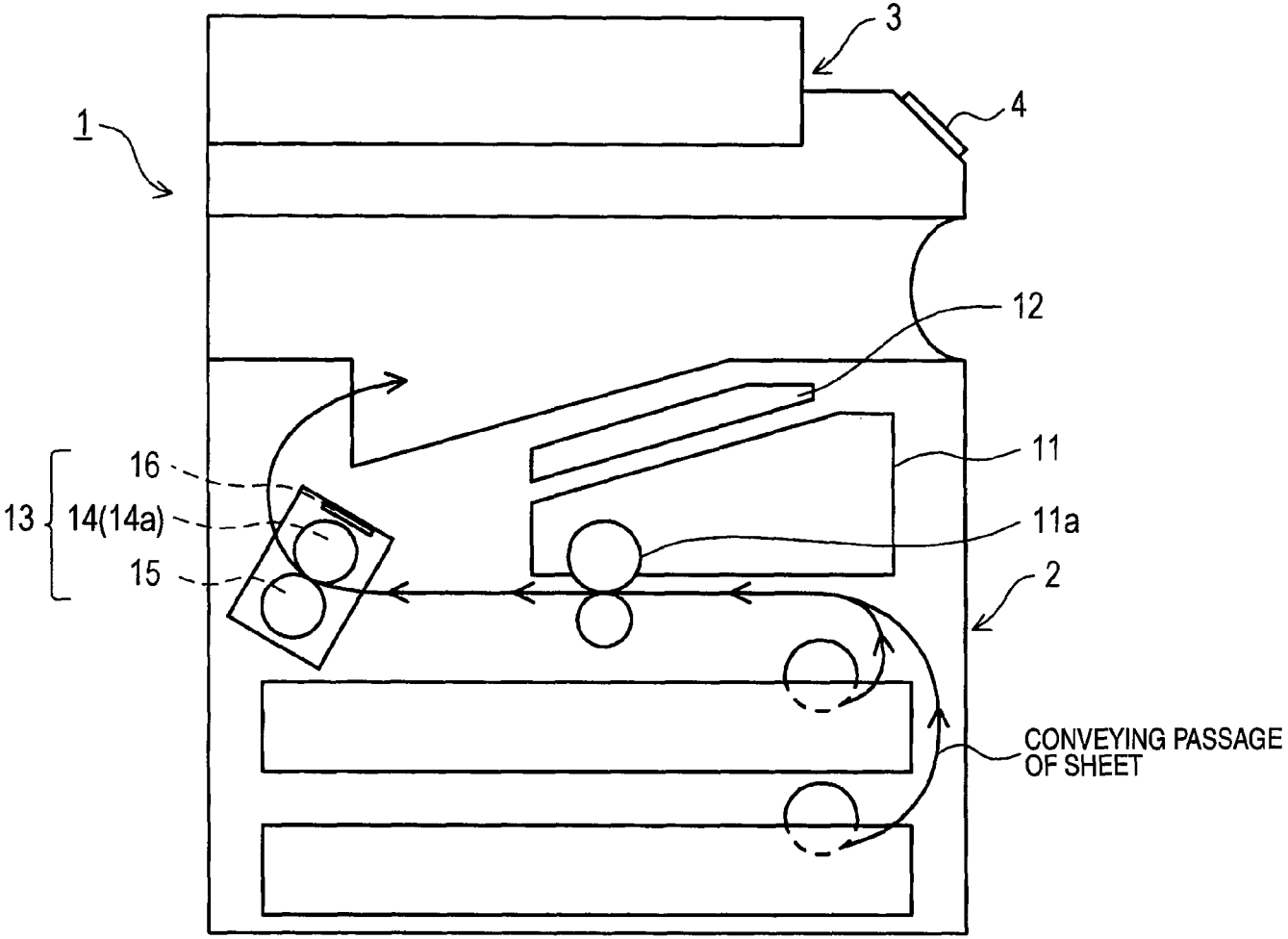
FIG. 2 is a schematic drawing to show a part of the image forming apparatus.

FIG. 1 is a block diagram to show the configuration of an image forming apparatus 1 according to an exemplary embodiment of the present invention. FIG. 2 is a schematic drawing to show a part of the image forming apparatus 1.

The image forming apparatus 1 is implemented as a multiple function device having the functions of a printer, a scanner, a copier, and a fax.

As shown in FIG. 1, the image forming apparatus 1 includes an image forming unit 2 for printing image information on a print medium, an image read unit 3 for reading image information recorded on a document, an operation panel 4 for providing cursor keys and switches for entering various settings and commands, a menu screen showing various menu items, user entry and error display, and the like, and a parallel I/F 5 for inputting and outputting image data from and to an external personal computer, and the like, through a parallel cable.

The image forming apparatus 1 further includes a control unit 10 for embodying the functions of a printer, a scanner, a copier, and a fax (multiple functions) by controlling the components of the apparatus in accordance with a command and setting entered through the operation panel 4 and by communicating image information through a general public line and also by performing heater control required for fixing a tone image onto a print medium of paper, an OHP sheet, and the like, which will be hereinafter referred to as print sheet.

The image forming apparatus 1 further includes components for the control unit 10 to perform heater control, specifically, a heater control circuit 20 for switching the conduction state of a heater 14*a* (described later) from an AC power source 40 (see FIG. 3), a zero crossing detection circuit 30 for detecting the timing at which an AC power voltage from the AC power source 40 becomes zero (zero crossing timing), and a temperature sensor 16 for detecting the temperature of the heater 14*a* described later and inputting the detection result to the control unit 10.

The image forming unit 2 includes an exposure device 12 for exposing a photoconductive drum 11*a*, a developing device 11 for supplying toner to the photoconductive drum 11*a* exposed by the exposure device 12 and generating a toner image to be transferred on a print sheet, a fixing device 13 for fixing the toner image generated by the developing device 11 and transferred to the print sheet, on the print sheet, and the like as shown in FIG. 2.

The fixing device 13 includes a heater roller 14 including a heater (for example, a halogen lamp) 14*a* therein, which consumes comparatively large power and a pressing roller 15 pressed against the heater roller 14. And, the fixing device 13 thermally fixes (fuses) the toner image on a print sheet while the print sheet passes through between the rollers 14 and 15. The heater 14*a* generates heat upon reception of power supply from the AC power source 40 (see FIG. 3) such as a commercial power supply. The temperature sensor 16 is provided in the vicinity of the center with respect to the length direction of the heater 14*a*.

[Heater Control Circuit]

Figure 3:
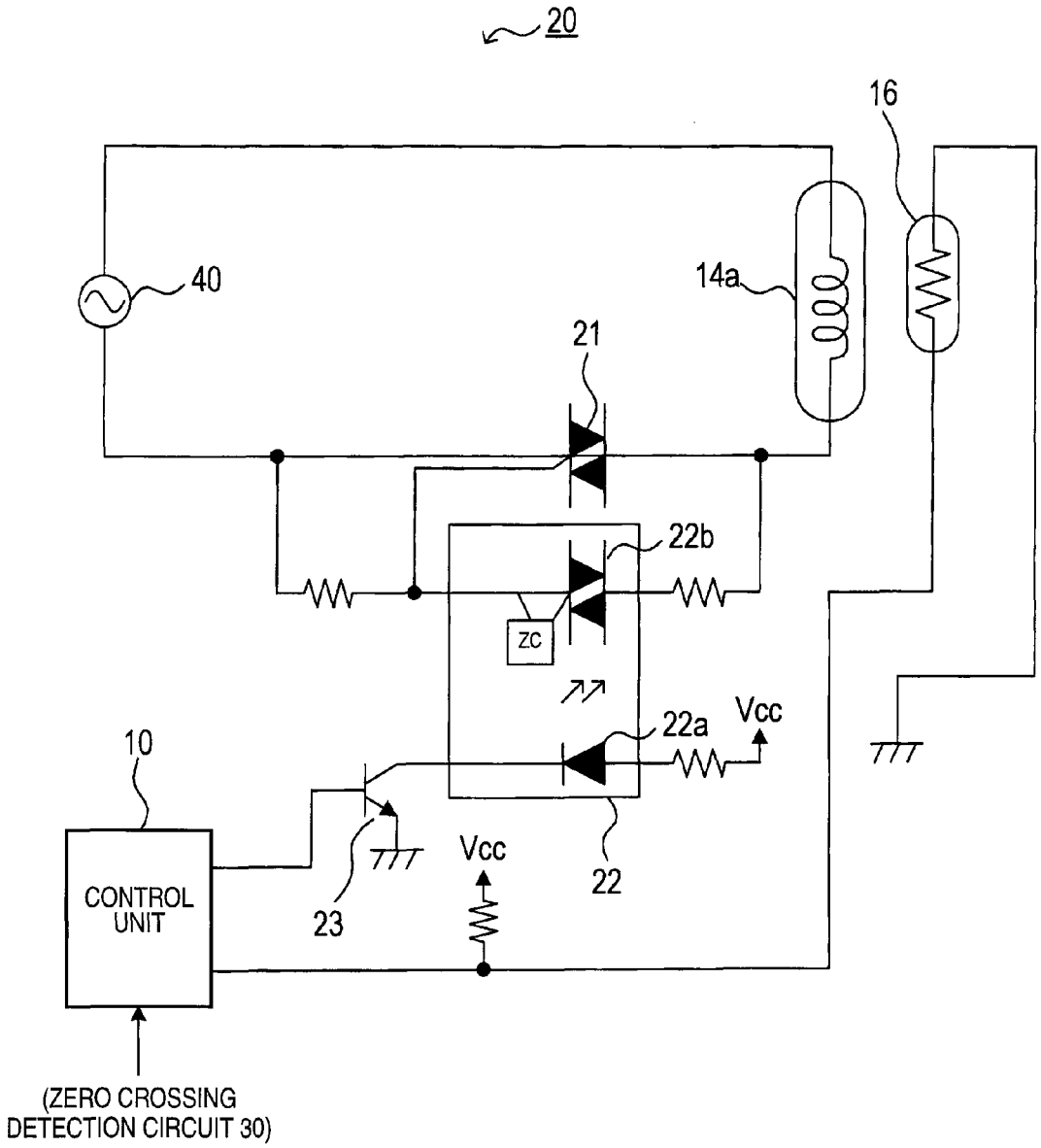
FIG. 3 is a circuit diagram to show the configuration of a heater control circuit according to an exemplary embodiment of the present invention.

FIG. 3 is a circuit diagram to show the configuration of the heater control circuit 20 in the exemplary embodiment.

As shown in FIG. 3, the heater control circuit 20 is a related-art circuit including a triac 21 for energizing and shutting off (ON and OFF) the heater 14*a* from the AC power source 40, a photo triac coupler 22 functioning as a switch of the triac 21, and a transistor 23 operating in accordance with an input signal from a base.

The photo triac coupler 22 ensures the creepage distance between a primary circuit connected to the heater 14*a* and a secondary circuit connected to the control unit 10. The photo triac coupler 22 includes a light emitting diode (LED) 22*a* as a light emitting element and a photo triac element 22*b* as a light receiving element. In this exemplary embodiment, the primary circuit and the secondary circuit are provided on the same insulating board. Herein, the creepage distance refers to the distance between the conductive portions of the primary circuit and the secondary circuit, represented by the shortest distance along the surface of the insulating board.

The photo triac coupler 22 is called zero crossing type. The photo triac coupler 22 operates in synchronization with the zero crossing timing as a zero crossing signal output from the zero crossing detection circuit 30 is input through the control unit 10. The photo triac coupler 22 turns ON the triac 21 at the first zero crossing timing in a time period during which light is emitted from the LED 22*a*, and turns OFF the triac 21 at the first zero crossing timing in a time period during which light is not emitted from the LED 22*a*.

Based on a heater control signal (described later) input from the control unit 10 connected to the base of the transistor 23 based on the detection result of the temperature sensor 16, the transistor 23 energizes the LED 22*a* if the heater control signal is ON; the transistor 23 does not energize the LED 22*a* if the heater control signal is OFF.

The heater control circuit 20 switches the conduction state of the heater 14*a* between ON and OFF in accordance with the heater control signal input from the control unit 10 and at the timing at which the AC power voltage becomes zero.

[Zero Crossing Detection Circuit]

Figure 4:
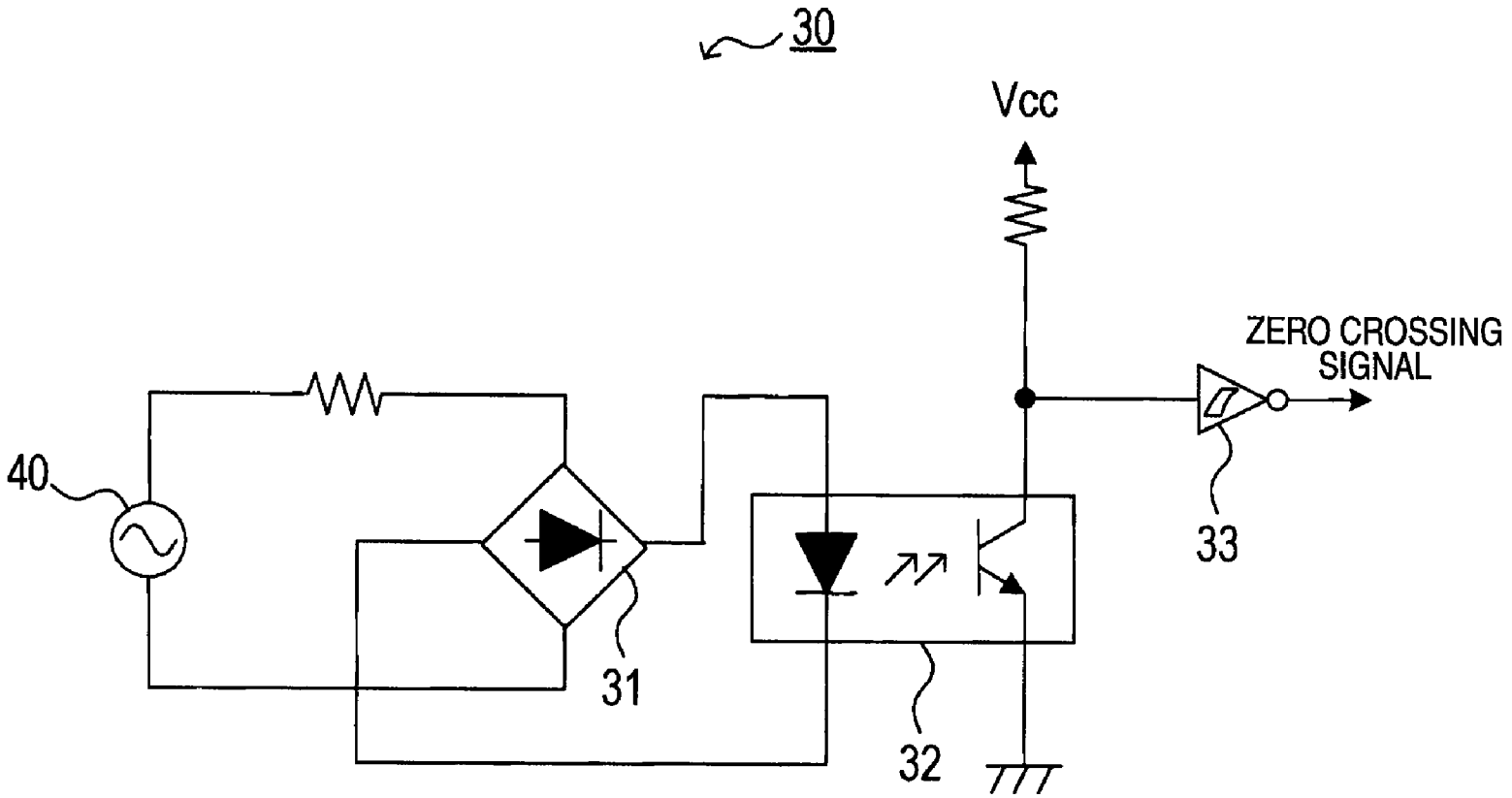
FIG. 4 is a circuit diagram to show the configuration of a zero crossing detection circuit according to an exemplary embodiment of the present invention.

FIG. 4 is a circuit diagram to show the configuration of the zero crossing detection circuit 30 in the exemplary embodiment.

As shown in FIG. 4, the zero crossing detection circuit 30 is a related-art circuit including a diode bridge 31 for full-wave rectifying an AC signal from the AC power source 40, a photocoupler 32 for outputting a pulse signal at a time when the level of the signal waveform rectified by the diode bridge 31 becomes low, and a hysteresis inverter 33 for generating a zero crossing signal based on the pulse signal input through the photocoupler 32.

The zero crossing detection circuit 30 outputs the zero crossing signal each time the zero crossing detection circuit 30 detects the timing at which the AC power voltage becomes zero.

[Control unit] The control unit 10 is implemented mainly as a related-art microcomputer including a central processing unit (CPU) 10*a*, a read only memory (ROM) 10*b*, a random access memory (RAM) 10*c*, a nonvolatile memory (for example, EEPROM) 10*d*, a bus line for connecting the components, and the like to one another. The control unit 10 performs various types of control for realizing the multiple functions and also executes heater control processing (described later) using the RAM 10*c* as a work area based on a program stored in the ROM 10*b*.

The RAM 10*c* is provided with at least a set area for storing setup data indicating the various settings made by the user through the operation panel 4. The memory 10*d* stores a control table 50 used for performing temperature control of the heater 14*a*.

[Control Table]

FIG. 5 is a matrix chart to show the arrangement of the control table 50 in the exemplary embodiment.

As shown in FIG. 5, in the control table 50, a heater heating rate 51 representing the heating rate of the heater 14*a*, an arrangement pattern 52 used to realize the heater heating rate 51, and an arrangement pattern repetition period 53 are associated with each other. The arrangement pattern repetition period 53 is hereinafter referred to as a control time period.

The arrangement pattern 52 represents the conduction state of the heater 14*a* with the AC power source 40 for each unit interval in the control time period 53 wherein the unit interval corresponds to the half-wave period of AC power voltage. The conduction state is also referred to as a heater state. The heater state is represented by the ON interval corresponding to a unit interval during which the heater should be turned ON and the OFF interval corresponding to a unit interval during which the heater should be turned OFF.

In the arrangement pattern 52, the ON and OFF intervals are arranged so that the first unit interval (half wave 1) in the control time period 53 is an ON interval (except when the heater heating rate 51 is 0%) and the last unit interval is an OFF interval (except when the heater heating rate 51 is 100%), and that the ON and OFF intervals are equal as much as possible.

That is, in the arrangement pattern 52, the ON and OFF intervals are arranged so that either ON or OFF intervals with the smaller number of the unit intervals (half waves) in the control time period 53 are not successive, and that number of the unit intervals (half waves) included in the ON successive interval during which the ON intervals are successive or the OFF successive interval during which the OFF intervals are successive becomes the minimum. For example, as shown in FIG. 5, if the heater heating rate 51 is 71%, the control time period 51 includes five ON intervals and two OFF intervals, and thus the intervals are arranged so that the OFF intervals with the smaller number are not successive. If the heater heating rate 51 is 29%, the control time period 51 includes two ON intervals and five OFF intervals, and thus the intervals are arranged so that the ON intervals with the smaller number are not successive. That is, if the heater heating rate 51 is greater than 50%, the number of the OFF intervals is smaller than that of the ON intervals, and thus the intervals are arranged so that the OFF intervals are not successive; if the heater heating rate 51 is smaller than 50%, the number of the ON intervals is smaller than that of the OFF intervals, and thus the intervals are arranged so that the ON intervals are not successive.

The control time period 53 is represented by the number of the unit intervals N with the maximum value 7. The number of the unit intervals is also referred to as a half wave number N. The half wave number N is set to a number satisfying M/N becoming an irreducible fraction if the heater heating rate 51 of M/N is represented by the arrangement pattern 52 made up of M of ON intervals and N-M of OFF intervals. This means that the half wave number N is set to the minimum number necessary for representing the heater heating rate 51; for example, if the heater heating rate 51 is 75% (¾), the half wave number N is set to four.

The heater heating rate 51 in this exemplary embodiment is set to be switchable among 100%, 75% (¾), 71% (5/7), 67% (⅔), 60% (⅗), 57% (4/7), 50% (½), 43% (3/7), 40% (⅖), 33% (⅓), 29% (2/7), 25% (¼), and 0%.

[Heater Control Processing]

Figure 6:
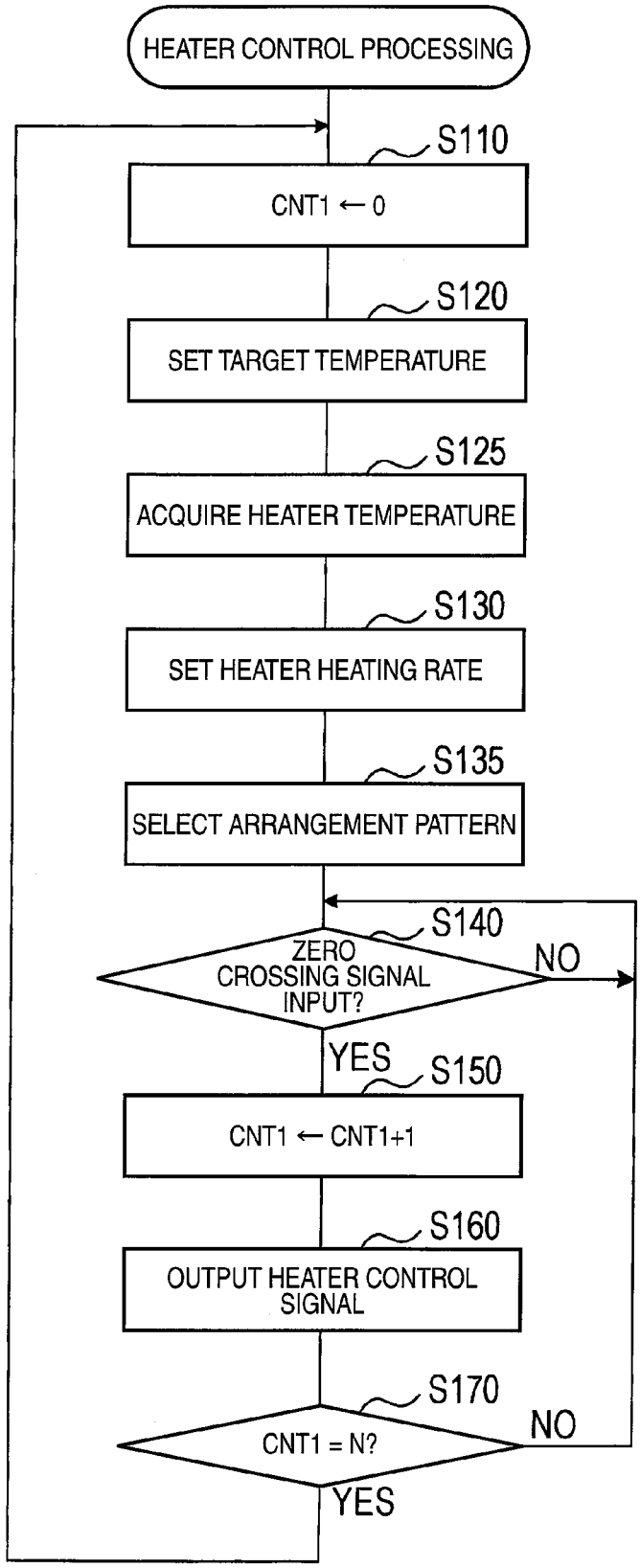
FIG. 6 is a flowchart to show the details of heater control processing executed by a CPU according to an exemplary embodiment of the present invention.
Figure 8A:
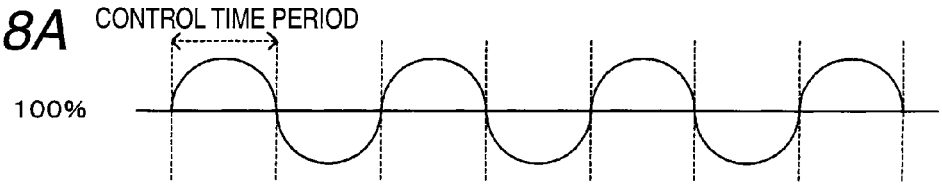
FIGS. 8A to 8G are AC waveform charts to show repetition frequency F in an exemplary embodiment of the present invention.
Figure 8B:
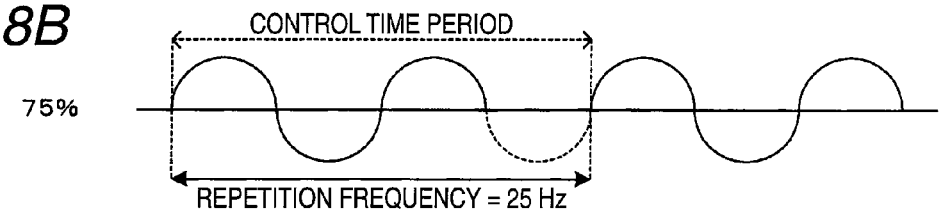
Figure 8C:
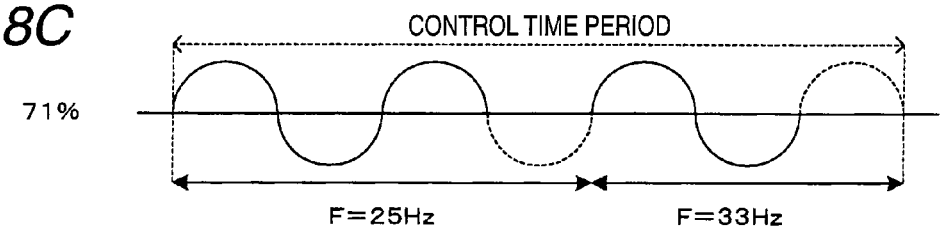
Figure 8D:
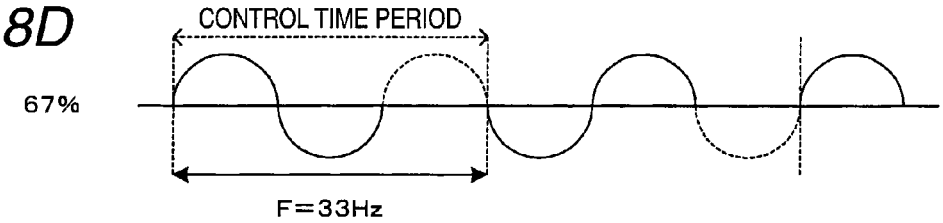
Figure 8E:
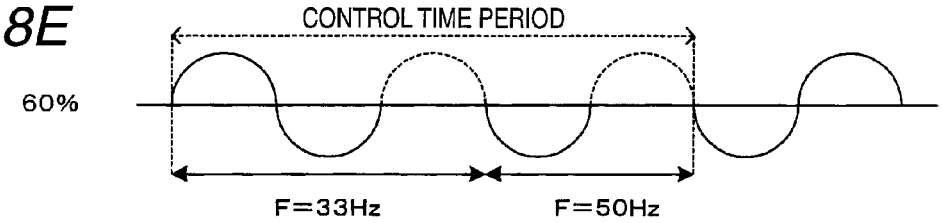
Figure 8F:
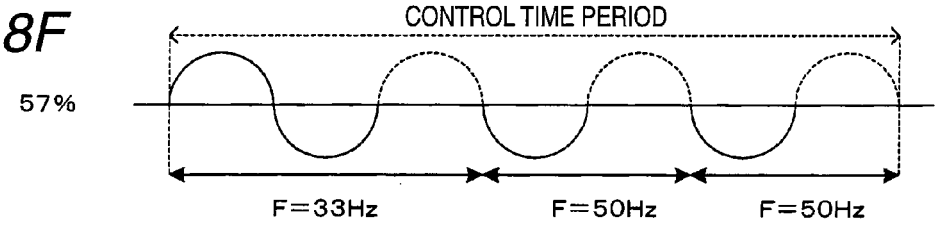
Figure 8G:
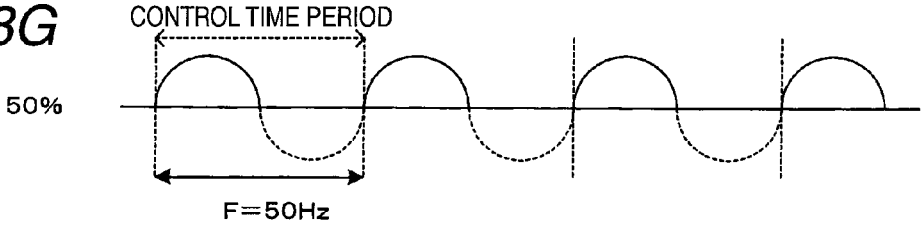

The heater control processing executed by the CPU 10*a* will be described in detail with a flowchart of FIG. 6. Upon reception of a command to print image information on a print sheet through the operation panel 4, the parallel I/F 5, or a telephone line, and the like, the heater control processing is started and is executed until completion of the print based on the command. In the heater control processing, a counter for updating a count CNT1 each time a zero crossing signal is input is used. The counter is also referred to as a half wave number counter).

At first, when the heater control processing is started, the count CNT1 of the half wave number counter is reset to 0 (S110).

Next, the target temperature according to the type of print sheet (OHP, thin paper, recycled paper, ordinary paper, or cardboard) selected by the user is set based on the setup data stored in the set area of the RAM 10*c* (S120) and the heater temperature is acquired from the temperature sensor 16 (S125).

As shown in FIG. 7A, the target temperature in this exemplary embodiment is set to 185° C. when the type of print sheet is OHP, 195° C. when the type of print sheet is thin paper, 205° C. when the type of print sheet is recycled paper, 213° C. when the type of print sheet is ordinary paper, or 220° C. when the type of print sheet is cardboard.

The heater heating rate 51 is set based on difference ΔT between the target temperature set at S120 and the heater temperature acquired at S125 (target temperature−heater temperature) (S130), whereby the arrangement pattern 52 associated with the heater heating rate 51 set at S130 is selected out of the control table 50 stored in the memory 10*d* (S135).

As shown in FIG. 7B, the heater heating rate 51 in this exemplary embodiment is set to 100% when the difference ΔT between the target temperature and the heater temperature exceeds 6° C., 75% when the difference ΔT is 5° C. to 6° C., 71% when the difference ΔT is 4° C. to 5° C., 67% when the difference ΔT is 3° C. to 4° C., 60% when the difference ΔT is 2° C. to 3° C., 57% when the difference ΔT is 1° C. to 2° C., 50% when the difference ΔT is 0° C. to 1° C., . . . , 0% when the difference ΔT is −5° C. or less.

Next, a standby mode is entered until a zero crossing signal is input from the zero crossing detection circuit 30 (NO at S140). When a zero crossing signal is input (YES at S140), the count CNT1 of the half wave number counter is incremented by one (S150). The zero crossing signal input from the zero crossing detection circuit 30 is output to the heater control circuit 20.

Using the control table 50 stored in the memory 10*d*, the unit interval (ON or OFF interval) corresponding to the count CNT1 incremented at S150 is referenced in the arrangement pattern 52 selected at S135, and a heater control signal to set the heater state to ON or OFF is output (S160).

For example, when the arrangement pattern 52 corresponding to the heater heating rate 51 of 71% is selected at S135, if the count CNT1 incremented at S150 is four, the unit interval (half wave 4) corresponding to the count CNT1 becomes an OFF interval (see FIG. 5), and thus a heater control signal to set the heater state to OFF is output.

Then, it is determined whether the count CNT1 incremented at S150 matches the half wave number N associated with the heater heating rate 51 set at S130 (S170). If the count CNT1 does not match the half wave number N (NO at S170), S140 is executed again; if the count CNT1 matches the half wave number N (YES at S170), S110 is executed again.

That is, the processing is repeated, whereby the heater heating rate 51 is always reset at the last unit interval in the control time period 53 set for each arrangement pattern 52. Each time the zero crossing signal is input, a heater control signal in the ON or OFF state is output.

The heater control circuit 20, to which the heater control signal is input, switches the conduction state of the heater 14*a* to ON or OFF at the next zero crossing timing.

[Operation example] In the above-described image forming apparatus 1, upon reception of a command to print image information on a print sheet through the operation panel 4, the parallel I/F 5, or a telephone line and the like, the heater temperature is adjusted (heater control processing), and when the heater temperature reaches the vicinity of the target temperature (for example, −2° C.≦ΔT≦2° C.), print is started. Upon completion of all print, the heater 14*a* is turned off.

The heater state at the executing time of the heater control processing is switched to ON or OFF with the switching frequency being 25 times or more per second (namely, repetition frequency F 25 Hz or more) if the AC power source 40 is a commercial power source of 50 Hz, for example, in the control time period 53 set to the minimum length according to the heater heating rate 51 while ensuring the switching at the zero crossing timing, as shown in FIG. 8A to 8G.

Figure 9A:
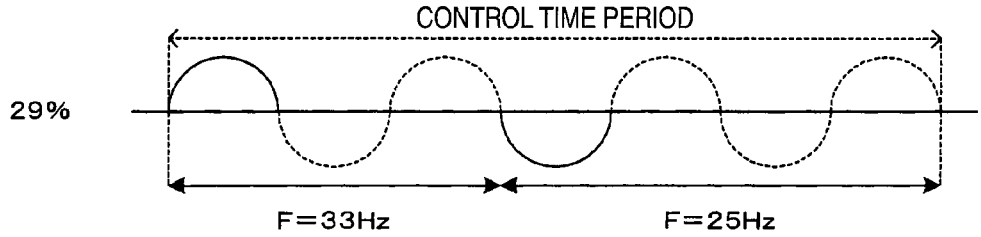
FIGS. 9A and 9B are AC waveform charts to show comparison between the repetition frequency F in an exemplary embodiment of the present invention and that in a related art.
Figure 9B:
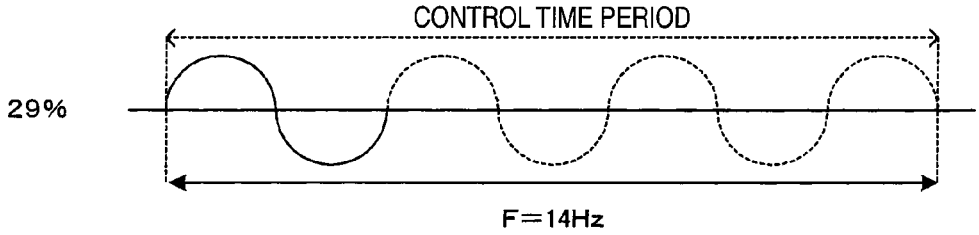

For example, in the heater state wherein the heater heating rate 51 is 29% in the this exemplary embodiment, the switching frequency becomes 25 or 33 times per second (namely, the repetition frequency F becomes 25 Hz or 33 Hz) as shown in FIG. 9A. The switching frequency (repetition frequency F) is better if the frequency is higher than the level at which flicker is offensive to a human being, 8.8 Hz; and the higher is further better. In this connection, if the arrangement pattern 52 corresponding to the same heater heating rate 51 (=29%) is a pattern with successive ON intervals in the control time period 53, the switching frequency becomes 14 times per second (namely, the repetition frequency F becomes 14 Hz) as shown in FIG. 9B and it is seen that the switching frequency becomes a closer value to 8.8 Hz as compared with that in this exemplary embodiment.

[Advantages]

As described above, in the image forming apparatus 1 of this exemplary embodiment, the control unit 10 outputs a heater control signal to set the heater state to ON or OFF to the heater control circuit 20 in accordance with the arrangement pattern 52 wherein the ON and OFF intervals are arranged so that the ON or OFF intervals with the smaller number of the unit intervals (half waves) in the control time period 53 are not successive. In other words, in the arrangement pattern 52, the ON and OFF intervals are arranged so that the ON or OFF intervals, a number of which is smaller are not successive.

Therefore, according to the image forming apparatus 1 of the exemplary embodiment, the switching frequency of the heater state in the repetition period of the arrangement pattern 52 increases, so that an increase in the change period of the illuminance of a lighting emitter connected to the same power line as the heater (illuminance change period) can be suppressed and by extension flicker can be suppressed without degrading the accuracy of the temperature adjustment.

In the arrangement pattern 52 according to this exemplary embodiment, ON and OFF intervals to set the heater state to ON and OFF are arranged using a maximum of seven unit intervals each corresponding to the half wave period of the AC power voltage, so that the heater heating rate 51 can be changed in multiple steps, and therefore, the accuracy of the temperature adjustment can be enhanced.

In the arrangement pattern 52 according to this exemplary embodiment, the repetition period of the arrangement pattern 52 is shortened as much as possible, whereby it is made possible to make a rapid transition to another arrangement pattern 52, and therefore, the accuracy of the temperature adjustment can be enhanced.

According to the above-described exemplary embodiment, at the time of passage of the last unit interval (half wave) in the repetition period of the arrangement pattern 52, it is made possible to make a transition to another arrangement pattern 52, so that the arrangement pattern is not disordered, and therefore, the availability of control can be enhanced.

According to the above-described exemplary embodiment, the heater heating rate 51 is set based on the temperature of the heater 14*a* detected at the unit interval (half wave) immediately preceding the transition time to another arrangement pattern, so that the accuracy of the temperature adjustment can be furthermore enhanced.

According to the above-described exemplary embodiment, the control table 50 stored in the memory 10*d* is used for controlling the heater 14*a*. Accordingly, the arrangement pattern 52 can be rapidly determined using the preset control table.

In the arrangement pattern 52 according to this exemplary embodiment, the ON and OFF intervals are arranged so that the first unit interval (half wave 1) in the control time period 53 is an ON interval (except when the heater heating rate 51 is 0%) and the last unit interval is an OFF interval (except when the heater heating rate 51 is 100%). Accordingly, when a transition is made from the last unit interval (half wave) in the previously used arrangement pattern 52 to another arrangement pattern, the heater state is reliably switched, so that the heater state switching period can be prevented from becoming slow, and therefore, flicker can be preferably suppressed.

Further, in the arrangement pattern 52 according to this exemplary embodiment, the ON and OFF intervals are arranged so that the number of the unit intervals included in the ON successive interval during which the ON intervals are successive or the OFF successive interval during which the OFF intervals are successive becomes the minimum, and if the AC power source 40 is a commercial power supply of 50 Hz, for example, the switching frequency of the heater state becomes 25 times or more per second (namely, the repetition frequency F becomes 25 Hz or more). Thus, an increase in the illuminance change period can be furthermore suppressed.

OTHER EXEMPLARY EMBODIMENTS

While the present invention has been shown and described with reference to certain exemplary embodiments thereof, it will be understood by those skilled in the art that various changes in form and details may be made therein without departing from the spirit and scope of the invention as defined by the appended claims.

For example, in the arrangement pattern 52 according to the exemplary embodiment, the ON and OFF intervals to set the heater state to ON and OFF are arranged in the control time period 53 involving a maximum of seven unit intervals (namely, the maximum value of the half wave number N is seven). However, the maximum value of the half wave number N is not limited to seven and may be set to a number according to the control design in the range in which the repetition frequency F required for suppressing flicker can be ensured.

It is noted that, the repetition frequency F is represented by the reciprocal of the period in which the heater state is switched to ON or OFF, and should be a value higher than 8.8 Hz, the level at which flicker is offensive to a human being, and should be a value as high as possible.

In the arrangement pattern 52 according to the exemplary embodiment, the ON and OFF intervals are arranged so that the number of the unit intervals included in the ON successive interval during which the ON intervals are successive or the OFF successive interval during which the OFF intervals are successive becomes the minimum, but the invention is not limited to this mode if the ON and OFF intervals may be arranged so that the ON or OFF intervals with the smaller number of the unit intervals (half waves) in the control time period 53 are not successive.

Further, in the arrangement pattern 52 according to this exemplary embodiment, the ON and OFF intervals are arranged so that the first unit interval (half wave 1) in the control time period 53 becomes an ON interval and the last unit interval becomes an OFF interval, but the invention is not limited to the mode. The ON and OFF intervals may be arranged so that the first unit interval (half wave 1) becomes an OFF interval or that the last unit interval varies according to the heater heating rate 51.

In the arrangement pattern 52 according to the exemplary embodiment, the first unit interval in the control time period 53 may be ON interval or OFF interval. If the first unit interval is ON interval, the heater temperature can be promptly increased. If the first unit interval is OFF interval, the heater temperature can be promptly decreased.

In the above-described exemplary embodiment, the arrangement pattern 52 is selected from the control table 50 stored in advance, but not limited to this mode. For example, the arrangement pattern 52 may be calculated each time the arrangement pattern 52 is set.

The heater control processing according to the exemplary embodiment is applied to the image forming apparatus 1, but not limited to the image forming apparatus 1. The heater control processing of the present inventive concept may be used with various types of apparatus including a heater.

What is claimed is:

1. A heater controller comprising:

a switching unit which switches a conduction state of a heater with an AC power source between ON and OFF at a timing at which an AC power voltage from the AC power source becomes zero; and a control unit which controls the switching unit at each unit interval corresponding to a half wave period of the AC power voltage, wherein the control unit outputs a switch signal for switching the conduction state to the switching unit based on a pattern in a control time period set as an integral multiple of the half wave period, and wherein in the pattern, ON intervals in which the conduction state is to be ON, and OFF intervals in which the conduction state is to be OFF are arranged so that one of the ON intervals and the OFF intervals, a number of which is smaller are not successive within the control time period.

2. The heater controller according to claim 1, further comprising:

a temperature detection unit which detects a temperature of the heater; and a rate setting unit which sets an ON/OFF rate indicating a rate of the ON intervals or a rate of the OFF intervals in the control time period based on the temperature detected by the temperature detection unit, wherein the control unit sets the control time period to a minimum period necessary for representing the ON/OFF rate set by the rate setting unit.

3. The heater controller according to claim 2, further comprising a zero crossing detection unit which outputs a zero crossing signal each time detecting a timing at which the AC power voltage becomes zero, wherein the control unit counts a cumulative number of times the zero crossing detection unit outputs the zero crossing signal, and wherein when the cumulative number reaches the number of the unit intervals included in the control time period, the control unit resets the cumulative number to zero and changes the pattern according to the ON/OFF rate set by the rate setting unit.

4. The heater controller according to claim 2, wherein the rate setting unit sets the ON/OFF rate at a last unit interval in the current control time period.

5. The heater controller according to claim 2, further comprising a storage unit which stores a control table associating the ON/OFF rate with the pattern, wherein the control unit uses the control table stored in the storage unit to control the switching unit.

6. The heater controller according to claim 1, wherein in the pattern, the ON and OFF intervals are arranged so that the number of unit intervals included in an ON successive interval during which the ON intervals are successive or in an OFF successive interval during which the OFF intervals are successive becomes a minimum.

7. The heater controller according to claim 1, wherein in the pattern, the ON and OFF intervals are arranged so that the conduction states in a first unit interval and a last unit interval in the control time period are different.

8. The heater controller according to claim 1, wherein in the pattern, the ON and OFF intervals are arranged so that a first unit interval in the control time period is an ON interval.

9. The heater controller according to claim 1, wherein in the pattern, the ON and OFF intervals are arranged so that a first unit interval in the control time period is an OFF interval.

10. An image forming apparatus comprising:

a fixing unit including a heater which heats toner transferred on a record sheet to fix the toner on the record sheet;

a switching unit which switches a conduction state of the heater with an AC power source between ON and OFF at a timing at which an AC power voltage from the AC power source becomes zero; and a control unit which controls the switching unit at each unit interval corresponding to a half wave period of the AC power voltage, wherein the control unit outputs a switch signal for switching the conduction state to the switching unit based on a pattern in a control time period set as an integral multiple of the half wave period, and wherein in the pattern, ON intervals in which the conduction state is to be ON, and OFF intervals in which the conduction state is to be OFF are arranged so that one of the ON intervals and the OFF intervals, a number of which is smaller are not successive within the control time period.

11. A heat controller comprising:

a setting unit which sets a conduction state of a heater with an AC power source to ON or OFF at a timing at which an AC power voltage from the AC power source becomes zero;

a temperature detection unit which detects the temperature of the heater;

a rate setting unit which sets an ON/OFF rate indicating a rate of the ON intervals in which the conduction state is to be ON or a rate of the OFF intervals in which the conduction state is to be OFF in a control time period based on the temperature detected by the temperature detection unit;

a varying unit which varies the control time period based on the ON/OFF rate set by the ON/OFF rate; and a control unit which controls the setting unit based on the ON/OFF rate set by the rate setting unit in the varied control time period.

* * * * *